United States Patent [19]

Kim et al.

[11] Patent Number: 4,903,901

[45] Date of Patent: Feb. 27, 1990

[54] PULVERIZED COAL FLOW CONTROLLER

[76] Inventors: Raymond K. Kim, 4731 Tanglewood Cir., NE., Canton, Ohio 44714; John B. Kitto, 1150 Seventh St., NE., North Canton, Ohio 44720

[21] Appl. No.: 276,822

[22] Filed: Nov. 28, 1988

Related U.S. Application Data

[63] Continuation-in-part of Ser. No. 197,926, May 24, 1988, which is a continuation of Ser. No. 106,830, Oct. 6, 1987, Pat. No. 4,830,287.

[51] Int. Cl.[4] ..... B02C 23/20

[52] U.S. Cl. ..... 241/33; 110/104 R; 110/186; 241/60; 241/119; 406/19

[58] Field of Search ..... 241/119, 60, 61, 57, 241/62, 18, 19, 48, 58, 59, 33, 34; 406/153, 19, 31, 194, 144, 145, 93, 109; 110/104 R, 186, 265

[56] References Cited

U.S. PATENT DOCUMENTS

| | | | |
|---|---|---|---|
| 1,953,125 | 4/1934 | Parker | 241/60 X |
| 2,070,368 | 2/1937 | Martin | 241/60 X |
| 4,498,633 | 2/1985 | Williams | 241/60 X |

OTHER PUBLICATIONS

"UKAEA Looks to Industry to Oil Its Valve Research", Lightowlers, Philip, *New Scientist,* 1 Oct. 1987.

*Primary Examiner*—Mark Rosenbaum

*Attorney, Agent, or Firm*—Daniel S. Kalka; Vytas R. Matas; Robert J. Edwards

[57] ABSTRACT

An apparatus and method for supplying a controlled flow of fluid transported solid particles, in particular, pulverized coal by the controlled injection of a fluid, such as a gas like compressed air, into at least one feed pipe. The flow of coal in feed pipes is controlled by selectively reducing or increasing the flow of primary air to achieve a balanced burner operation.

15 Claims, 5 Drawing Sheets

PULVERIZED COAL FLOW CONTROLLER

This application is a continuation-in-part of application Ser. No. 07/197,926 filed May 24, 1988 which is a continuation of Application Ser. No. 07/106,830 filed Oct. 6, 1987, now U.S. Pat. No. 4,830,287 granted May 16, 1989.

BACKGROUND OF THE INVENTION

1. Field of the Invention

The present invention relates in general to a pulverized coal flow control system, and more particularly, to a new and useful flow control system for accurately controlling the mass flow rate of pneumatically transported pulverized coal.

2. Description of the Related Art

In a pulverized coal burning boiler, one or more pulverizers are used to grind lumps of crushed coal into particulates with a certain desired size distribution. The airborne pulverized coal (PC) is typically transported to each burner in pipes ranging from 8–24 inches in diameter. The number of burners fed by one pulverizer can be anywhere from 2–13 supplied by as many pipes carrying the pulverized coal.

In a multiple-burner boiler operation, it is highly desirable to maintain a good balance among all the burners to attain high thermal efficiency and to maintain close control of stack emissions. The flow of pulverized coal is the single most important process variable that needs to be controlled to achieve balanced operation among several burners. Balanced burner operation requires that the mass flow rate of both air and pulverized coal be the same among all the pipes leading to the burner within certain operating limits. Each supply pipe or feed pipe installed between the pulverizer and the burner generally has a hydraulic resistance which is somewhat different from the other supply pipes or feed pipe lines due to differences in overall length of each pipe line, and the type and number of bends used for each pipe line. These variations in line resistance can cause an imbalance of the primary air and coal flow among the pulverized coal supply pipe lines. This possible imbalance must be corrected to insure efficient combustion.

Common industry practice is to add a fixed resistance orifice or sections of small diameter pipe in the line that has a lower resistance than desired as is illustrated by 8 and 9 in FIG. 1. Then the balancing of primary air flow in each line is confirmed by measuring the air flow in each line with a pitot tube in the absence of pulverized coal flow. However, the balanced primary air flow alone in the above situation does not necessarily insure a balanced pulverized coal flow in the system due to the asymmetric flow distribution at the pulverizer outlet and the peculiarities in the airborne solids flow. Plant operators have reported in excess of 10% deviation in pulverized coal flow from the average in a system that had been balanced for primary air flow using fixed resistance orifices and pipes.

While there are a number of pulverized coal flow meters at various stages of development in the industry, there has not been any commercially available flow control system for pulverized coal transport lines. The primary reason for the absence of such a system is because it is very difficult to design a reliable control element that can meet a set of very tough operational requirements, namely:

1. For long-term, reliable service, the control element must be highly erosion-resistant if it is to be exposed to flowing coal particles. The velocity of primary air in feed pipes is around 70 ft/sec at full load but can be as high as 100 ft/sec, and as low as 40 ft/sec at partial load. Pulverized coal moving at these high velocities is an extremely abrasive flowing medium that is capable of eroding away any common metallic intrusion in its stream;

2. The element must not appreciably increase the pressure drop of the line; the maximum tolerable increase in pressure drop would vary from plant to plant but the permissible increase is generally very small;

3. The element should not interfere with the normal flow of the primary air keeping the pulverized coal particles airborne when the controlling function is not needed;

4. The control should be sensitive enough to effect slight changes as small as 1–2% in pulverized coal mass flow rate; and 5. The control system needs to be readily retrofitable to existing plants at reasonable installation and operation cost.

U.S. Plant application Ser. No. 07/197,926 filed May 24, 1988 titled "Pulverized Coal Flow Control System" which is also owned by the present Assignee is a continuation of application Ser. No. 07/106,830 which was filed Oct. 6, 1987 and issued as U.S. Pat. No. 4,830,287 on May 16, 1989. This reference discloses a pulverized coal flow control system with an aspirator connected to the outer wall of a bend provided in the supply pipe. The aspirator draws off an amount of mixture from the supply pipe and re-injects it back into the pulverizer. As a result, the flow of mixture is controlled through the supply pipe.

The foregoing pulverized coal flow control system needs diverted control bypass lines which can be costly to install. The present invention provides for an arrangement that is totally free of these costly bypass lines which makes it simpler to install and operate while further eliminating the possibility of any pluggage in the bypass lines.

SUMMARY OF THE INVENTION

The present invention solves the aforementioned problems by providing a pulverized coal flow controller for controlling the flow of coal in feed pipes through the reduction in primary air flow. A number of jets or nozzles inject a fluid, such as compressed air for example into the pipe to interfere with the normal flow of primary air. The reduction of primary air flow is controlled by the fluid injection pressure. The injected fluid creates a local recirculation zone. The size of the local recirculation zone is proportional to the injection pressure, and the extent of flow reduction is proportional to the size of the recirculation zone.

Since the amount of coal carried in any line within a group of feedlines fed by a common pulverizer is proportional to the primary air flow rate in the line, a reduction in primary air flow causes a decrease in coal flow. Accordingly, the pulverized coal flow controller is designed to reduce the primary air in a feed pipe known to carry more than necessary to balance the burners.

In one embodiment of the present invention, the apparatus comprises a vessel for containing the mixture of fluid with suspended particles with at least one supply pipe connected to the vessel for supplying a flow of the mixture from the vessel to a workpiece, means for injecting a fluid into each feed pipe for controlling the flow of the fluid, and means for controlling the rate of injection. The present invention utilizes a plurality of injection nozzles spaced apart on each of the feed pipe as the injecting means and employs a computer to control the amount of fluid that each of the injection nozzles injects into the feed pipe. The apparatus of the present invention may further includes a bypass purge line which provides a limited fluid flow through each of the injection nozzles to prevent pluggage thereof when not in use.

The present invention also provides a method of supplying a controlled fluid flow with transported solid particles, comprising the steps of: suspending solid particles in a vessel to form a mixture of solid particles and fluid; discharging the mixture through at least one feed pipe out of the vessel to a workpiece; injecting a fluid into each feed pipe for reducing the flow of the mixture; and controlling the amount of fluid being injected in each feed pipe. The method may further include a step of providing fluid flow through a bypass purge line for preventing the pluggage of the injection nozzles. Preferably, the method injects the fluid at an angle opposite the flow of the mixture at an angle of about 45° to the pipe wall.

One aspect of the present invention provides an apparatus for supplying a controlled flow of pulverized coal to a pulverized coal-fired boiler.

Another aspect of the present invention provides an apparatus controlling fluid transported solid particles.

Still another aspect of the present invention provides a method for supplying a controlled flow of fluid transported solid particles.

A further aspect of the invention is to provide a pulverized coal flow controller which is simple in design, rugged in construction, and economical to manufacture.

The various features of novelty characterized in the invention are pointed out with particularity in the claims annexed to and forming a part of this disclosure. For a better understanding of the invention, and the operating advantages obtained by its use, reference is made to the accompanying drawings and descriptive matter in which a preferred embodiment of the invention is illustrated.

DESCRIPTION OF THE PREFERRED EMBODIMENT

Figure 1:
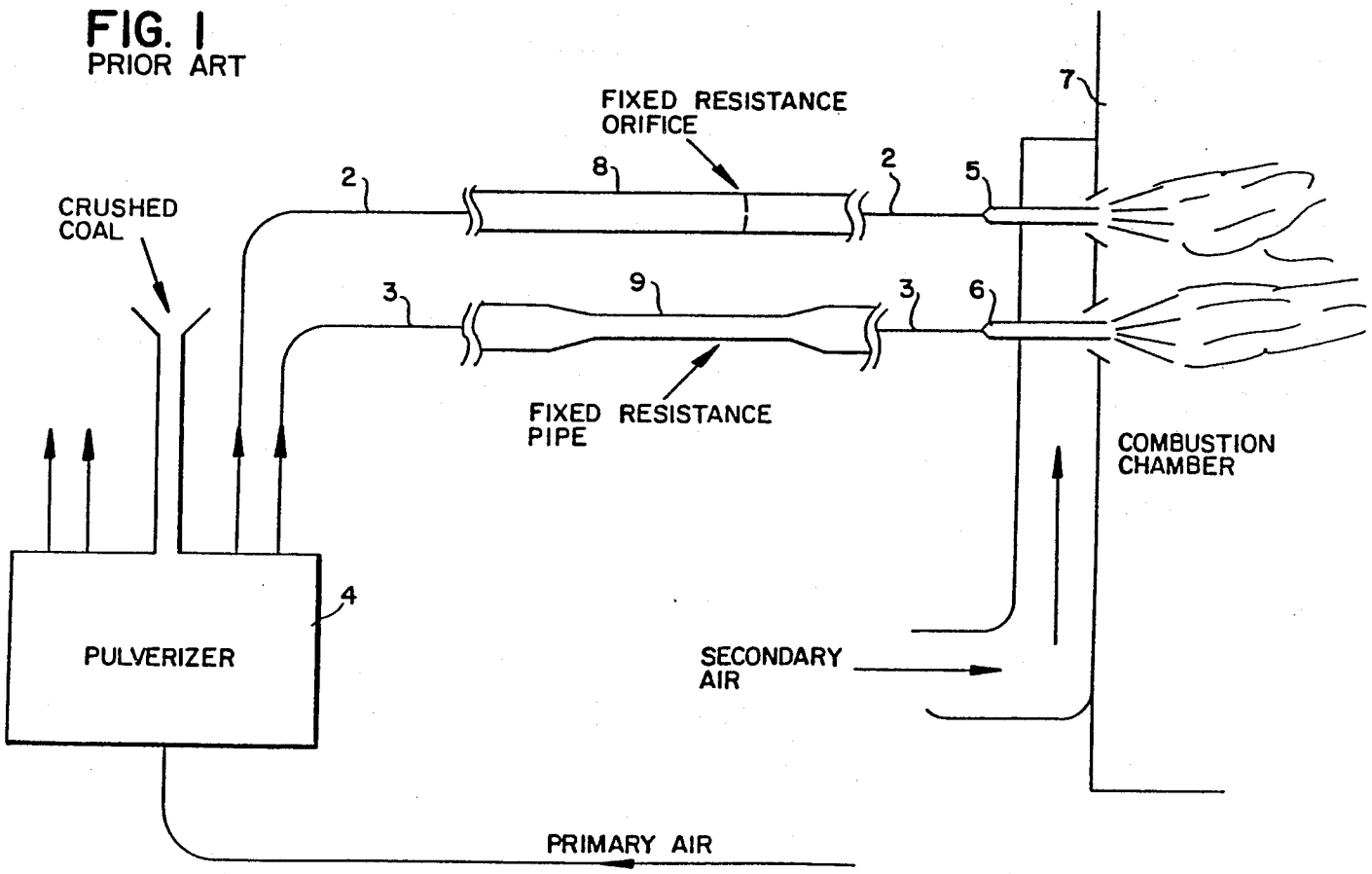
FIG. 1 PRIOR ART
FIG. 1 is a schematic representation of a prior art apparatus for supplying pulverized coal to the burners of a combustion chamber utilizing a fixed resistance orifice and pipe for balancing primary air flow for the suspended pulverized coal being supplied to the burners.

Referring to the drawings in which like reference characters designate like or corresponding parts throughout the several views, in particular, FIG. 1 illustrates the prior art approach for balancing the mass flow rate for pneumatically suspended pulverized coal supplied over a plurality of supply or feed pipes 2 and 3 from a pulverizer 4 to burners 5 and 6 of the combustion chamber 7. To this end, a fixed resistance orifice pipe 8 is provided in supply pipe 2 and a fixed resistance pipe 9 is provided in supply pipe 3. The use of these fixed resistances may still result in remaining imbalances of 10% or more. It has been speculated that an increase of ½% or more in boiler efficiency is achievable in many existing power plants by burner balancing beyond the 10% imbalance mentioned.

Balancing the burners of the mentioned efficiency requires control of three process variables: the primary air flow, the secondary air flow; and the pulverized coal flow. Among these, controlling the pulverized coal flow rate is the most difficult but economically the most rewarding. The reason for this difficulty lies in the fact that: (1) the pulverized coal flow, being extremely erosive, does not lend itself to typical conventional solutions such as variable-port valves used for most single phase fluids, and (2) the flow control must be achieved with a minimum of added resistance to the line when not active so that the existing primary air transport system remains essentially unaltered. According to the present invention, a more responsive and efficient control for pulverized coal flow rate is made possible which will not only yield cost savings but which will also produce a well balanced feed system able to more closely control stack emissions.

Figure 2:
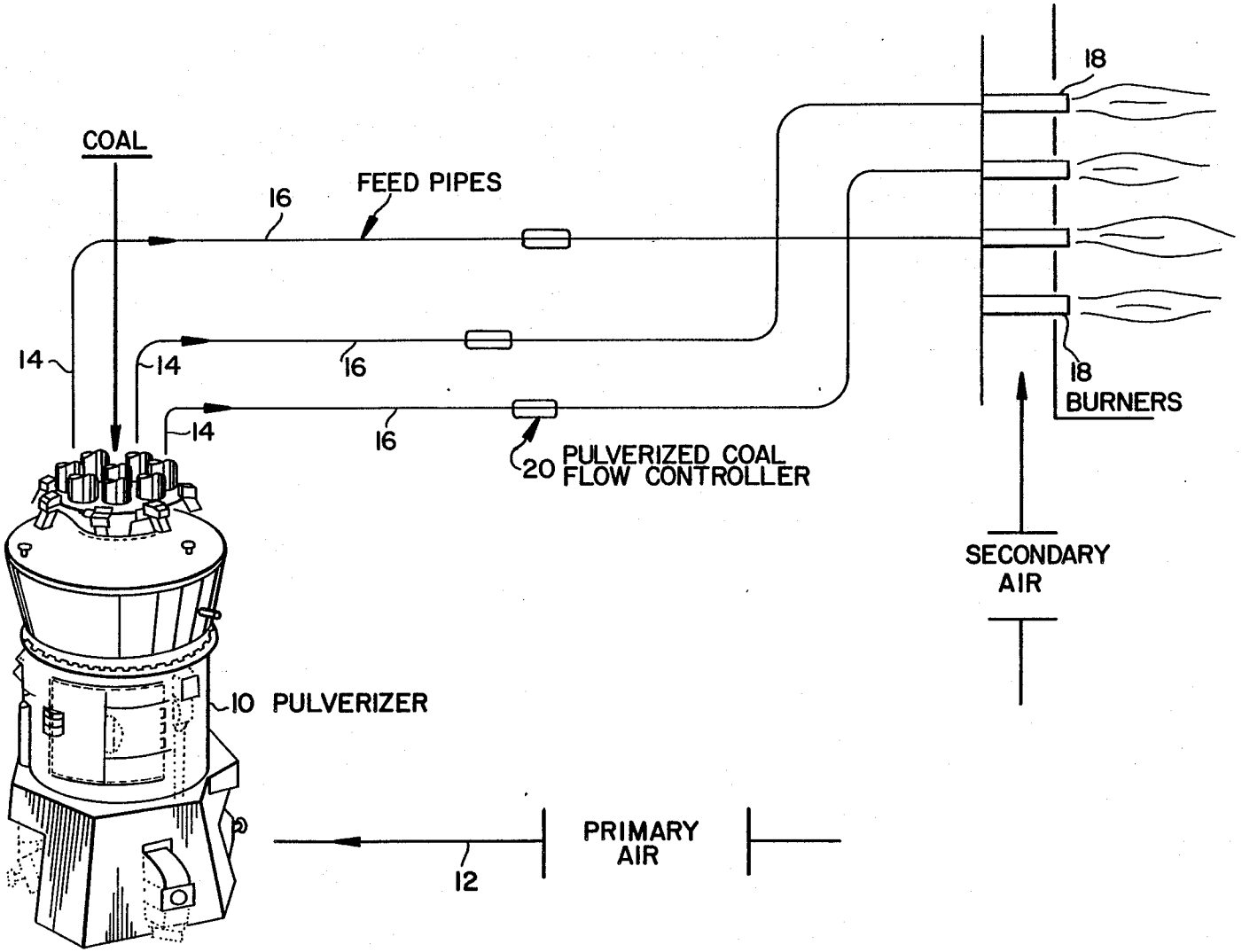
FIG. 2 is an illustration of feed or supply pipes carrying coal from a pulverizer to the burners in a boiler with the present invention in place.

Next, referring to FIG. 2, the present invention is shown in combination with the pulverizer 10 having grinding wheels (not shown) therein, for grinding the coal supplied thereto. Primary air 12 is supplied to the pulverizer 10 for pneumatically suspending solid particles of pulverized coal produced in the vessel 10. These solid particles are conveyed out of the vessel 10 through outlet pipes 14 having bends therein, however, for the present invention bends are unimportant. The outlet pipes 14 are connected to supply pipes or feed pipes 16 which ultimately reach the burners 18 of a furnace or a boiler. The pulverized coal flow controller generally designated as 20 is illustrated in place in each of the feed pipes 16. A flow meter 46 may be provided in each feed pipe 16 for measuring the flow and for providing a signal corresponding to the pulverized coal flow for communication with the computer controller 34 shown in FIG. 3.

Figure 3:
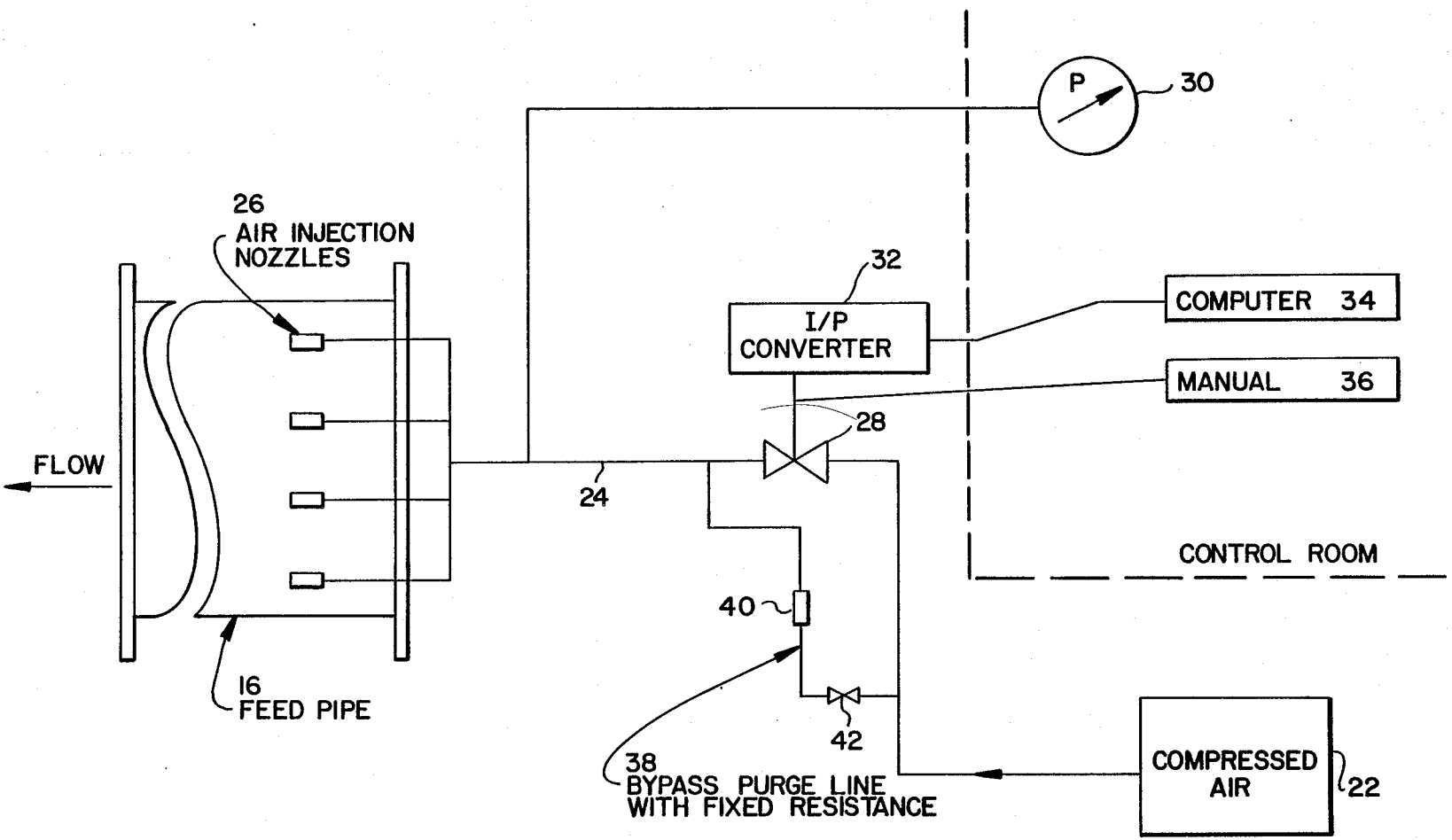
FIG. 3 is a schematic representation of the pulverized coal flow controller according to the present invention.

FIG. 3 is a schematic diagram of the pulverizer coal flow controller 20. Referring to that figure, there is shown a plurality of air injection nozzles 26 provided in each feed pipe 16, of course the injection nozzles 26 may include slits into the feed pipe 16. A source of fluid 22, preferably compressed air, provides air through duct 24 for injection into the feed pipe 16 through the nozzles 26. The air injection pressure is controlled by a pressure regulator 28 equipped with a current/pressure (I/P) converter 32 which is remotely operated by a computer 34. The I/P converter 32 is not necessary for a manual operation with a manual regulator 36. A pressure gauge 30 is provided for each feed pipe 16 to regulate the injection pressure in each line.

The injection nozzles 26 are spaced 3 or 4 inches apart on the outside of each feed pipe 16. At least one injection nozzle but preferably a plurality, is located in each feed pipe 16. For example, in an eighteen or sixteen inch diameter feed pipe 16 eight 3/16-inch diameter air injection nozzles are spaced three or four inches apart on the outside of the pipe. These injection nozzles 26 can be installed after drilling and tapping holes in the existing feed pipe 16, or by mounting the air injection nozzles 26 on a spool piece about a foot long, and inserting the spool piece in the feed pipe 16.

A small bypass purge line generally designated 38 provides air flow through the injection nozzles 26 to prevent pluggage when a control valve 28 is inactive. The dimensions, pressure, and details of the bypass purge line 38 depend mainly on the size and the number of the injection nozzles 26. In FIG. 3 the bypass line 38 is depicted with a fixed resistance 40 and an individual regulator 42 while FIG. 4 only shows the fixed resistance 40. In general, the larger the system, the smaller the fixed resistance 40 necessary in the bypass purge line 38 to ensure an air flow which prevents pluggage. While the purge line pressure upstream of the fixed resistance 40 is close to the supply air pressure 22, one or two psig would be sufficient at the nozzles 26 to keep them open when they are inactive.

Figure 4:
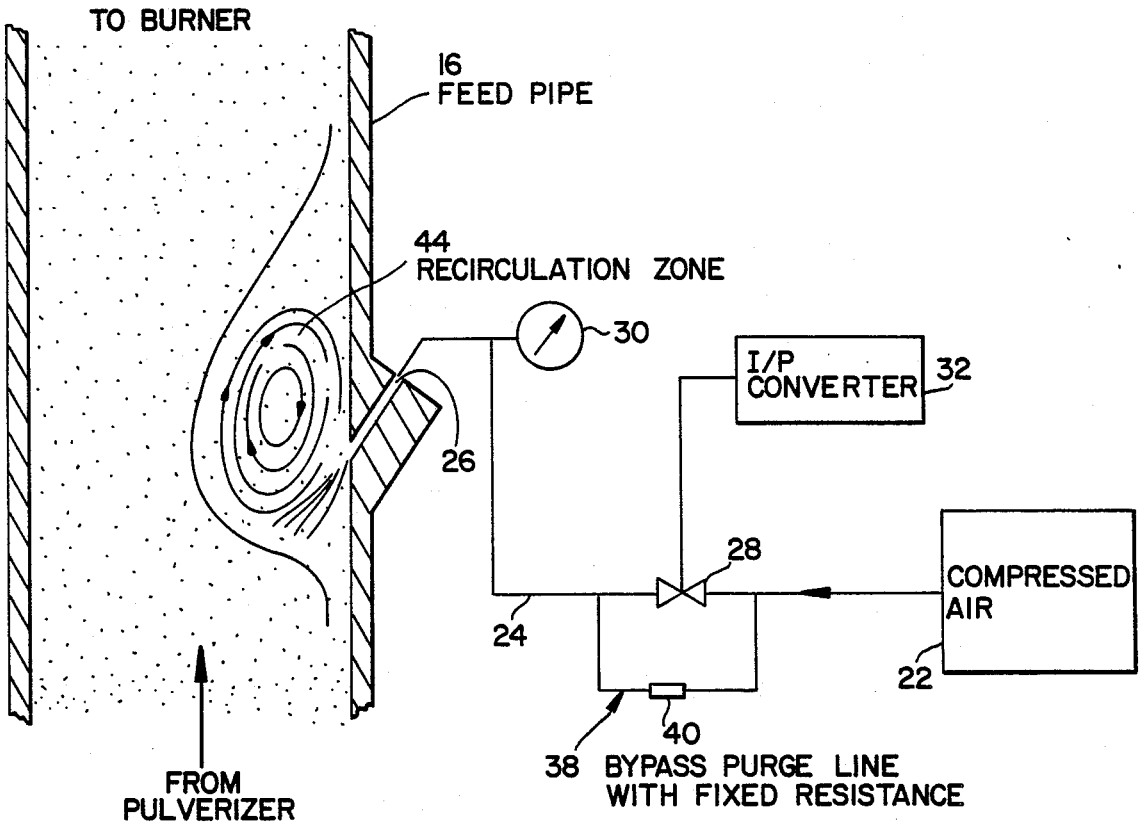
FIG. 4 is a cross-sectional illustration of an enlarged portion of a feed pipe as it is connected to a schematic representation of the present invention.

The pulverized coal flow controller 20 was conceived for the purpose of controlling the flow of coal by reducing the flow of primary air 12 in the feed pipe 16. A number of air jets or nozzles 26 inject air into the feed pipe 16 from a compressed gas source 22, to interfere with the normal flow of primary air 12 in the feed pipe 16 as depicted in FIG. 4. The reduction of the primary air flow 12 is controlled with air injection pressure. The air injection pressure creates recirculation zones 44. The size of the local recirculation zone 44, as best illustrated in FIG. 4, is proportional to the injection pressure, and the extent of flow reduction in the feed pipe 16 is proportional to the size of the recirculation zone 44. When an increase in coal flow is required, the coal feed rate into the pulverizer 10 is increased. This distributes more coal to all the feed lines 16 in the system. Then, the coal flows are balanced by activating the pulverized coal flow controller 20 in each feed pipe 16. The computer 34 in addition to controlling air injection pressure for each feed pipe 16 monitors the flow through feedback of the separate flow meters located in the lines.

As mentioned earlier, a typical arrangement of a coal distribution system includes a number of burners 18 fed by one pulverizer 10 through a plurality of feed pipe 16 which may number from 2–13. The pipe diameters of the feed pipe 16 may range from about 8–24 inches. The velocity of the primary air 12 in the feed pipe 16 is around 70 ft/sec at full load but can be as high as 100 ft/sec, and as low as 40 ft/sec at partial load.

As illustrated in FIG. 4, the injection nozzle 26 is preferably at an angle opposite the flow of the mixture of the transported coal particles and the primary air flow in the feed pipe 16. The angle of the injection nozzle 26 in the preferred embodiment is about 45" measured from the pipe wall, in a direction opposite the flow of the mixture.

Figure 5:
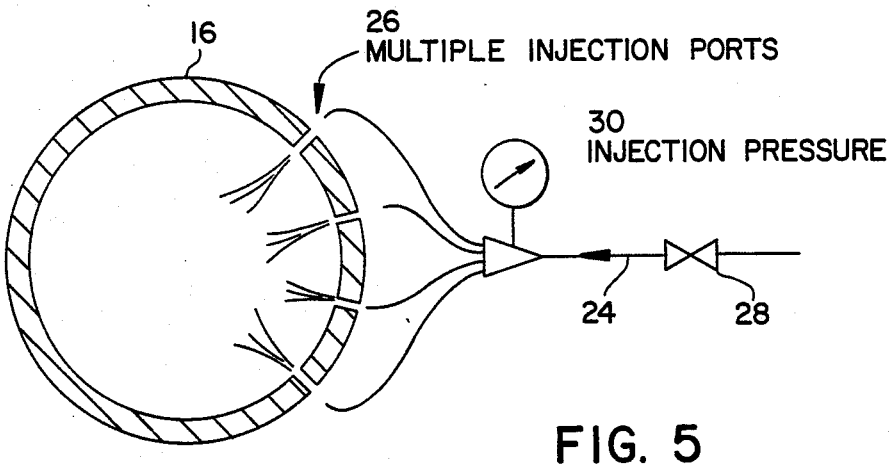
FIG. 5 is a lateral cross-section of a feed pipe employing the present invention.

FIG. 5 depicts an axial cross-section of a feed pipe 16 in which there are multiple injection ports 26 provided therein. The pressure gauge 30 indicates the injection pressure as regulated by regulator 28.

Based on the results of laboratory tests conducted on an experimental model, the following observations were noted:

1. Air flow injection of up to about 1% of the main flow is needed to reduce the main flow between 0%–15%.

2. Approximately 1.0 SCFM of control air is needed to reduce 1% of the main flow.

Figure 6:
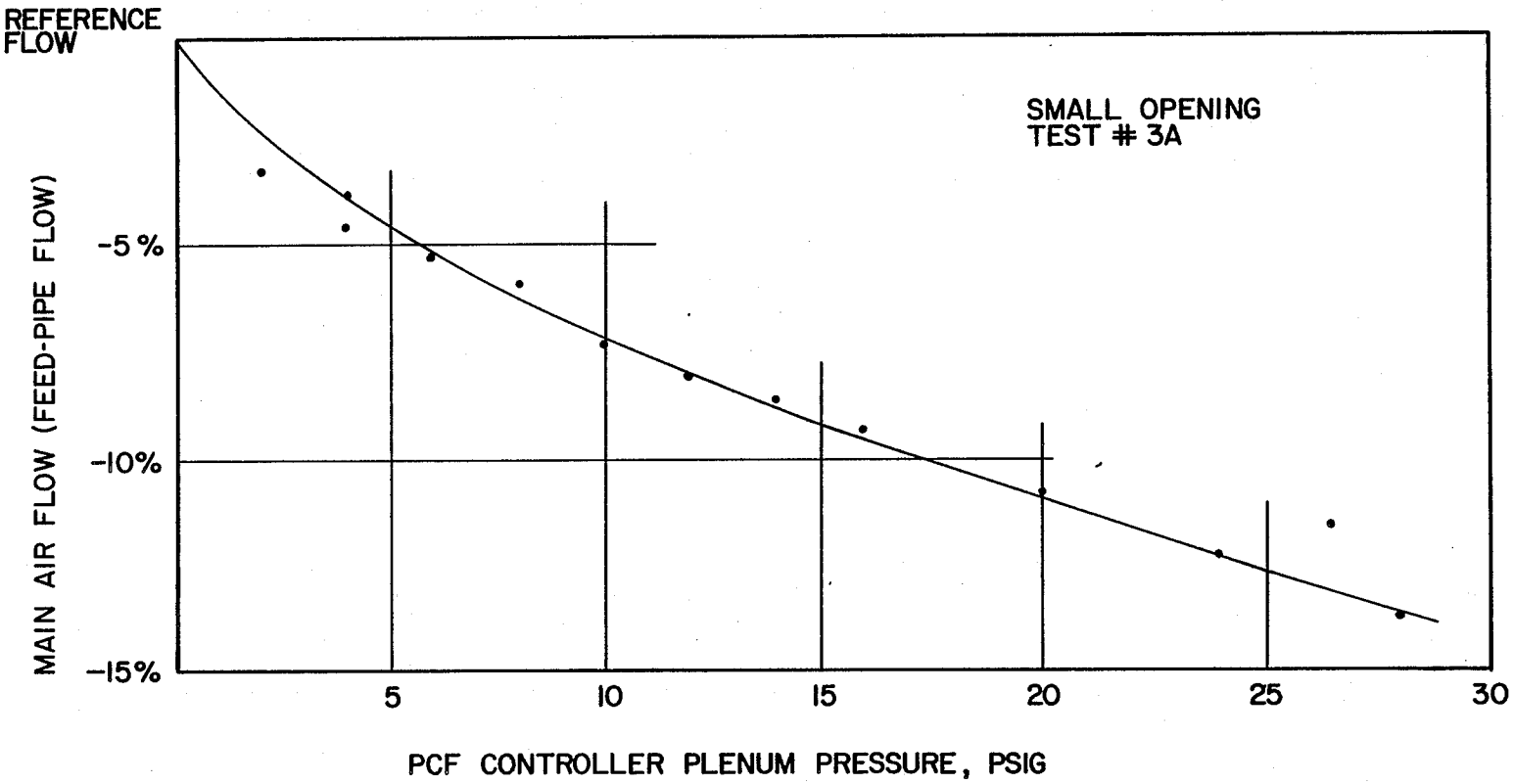
FIG. 6 is a graph of test results obtained with an experimental model.

FIG. 6 is a graph of the operating characteristics of the test system indicative of the type of control function that is desirable in the computer system 34. For instance, if a reduction 7% in a particular feed pipe 16 is desired, the computer 34 issues a command to adjust the pressure to 10 psig. Likewise, if a reduction of 5% is desired in a feed pipe 16, the compressed air pressure is adjusted to 6 psig for a pulverized coal flow controller operating under similar conditions Although the present invention was conceived primarily to solve the problems associated with the control of airborne coal particles at boiler plants, the present invention has wider applications in any fluid transport system carrying solid particles. The fluid may either be a gas or liquid. When employing a liquid fluid system, pumps generate injection pressure to decrease the fluid flow. Alternatively a gas may be used to decrease liquid fluid flow transporting solid particles.

Specifically the present invention is useful in applications where the flowing media is highly erosive, where the system cannot tolerate an appreciable increase in pressure drop, and where long-term reliable service is required. Many processes in the petrochemical, food processing, and pharmaceutical industries transport solid particles and powder pneumatically. The flow rates of the solids often need to be controlled on-line.

While a specific embodiment of the invention has been shown and described in detail to illustrate the applications and the principles of the invention, certain modifications and improvements will occur to those skilled in the art upon reading the foregoing description. It is thus understood that all such modifications and improvements have been deleted herein for the sake of conciseness and readibility, but are properly within the scope of the following claims. Such a modification would be to reverse the direction of some of the nozzles 26 to change the flow of primary air 12 in a feed pipe 16. Another modification is reducing a liquid fluid flow transporting solid particles with the injection of a liquid or a gas fluid.

We claim:

1. An apparatus for controlling the flow of fluid transported solid particles, comprising:

a vessel for containing a mixture of primary fluid with suspended particles;

at least one feed pipe connected to said vessel for supplying a flow of said mixture from said vessel;

means for injecting a fluid under pressure into each feed pipe, said injecting means being situated so that the injected fluid creates a recirculation zone proportional in size to the injection pressure of the fluid in each feed pipe, the size of the recirculation zone proportionally regulating the flow of primary fluid;

means for measuring the flow in each feed pipe and establishing a signal indicative thereof, said measuring means being positioned downstream from said injection means; and means for controlling the fluid injection pressure for each feed pipe responsive to the flow signal.

2. An apparatus as defined in claim 1, wherein said injection means includes a plurality of injection nozzles in each feed pipe.

3. An apparatus as defined in claim 2, wherein each of said injection nozzles is at an angle opposite the flow of said mixture.

4. An apparatus as defined in claim 2, further comprising a bypass purge line for providing fluid flow through said injection nozzles to prevent pluggage thereof.

5. An apparatus as defined in claim 1, wherein said controlling means includes a computer regulating a current/pressure converter.

6. An apparatus as defined in claim 1, wherein said fluid is compressed air.

7. A pulverized coal flow controller for controlling the flow of coal in feed pipes, comprising:

a pulverizer for containing a mixture of primary fluid with suspended coal particles;

a plurality of feed pipes connected to said pulverizer for supplying a flow of the mixture to a plurality of burners in a boiler;

means for injecting a fluid under pressure into at least one of said feed pipes, said injecting means being situated so that the injected fluid creates a recirculation zone proportional in size to the injection pressure of the fluid in the feed pipe, the size of the recirculation zone regulating proportionally the flow of primary fluid;

means for measuring the flow in the feed pipe and establishing a signal indicative thereof, said measuring means being positioned downstream from said injecting means; and means for controlling the fluid injection pressure for the feed pipe responsive to the flow signal to regulate the amount of fluid supplied therefrom.

8. A pulverized coal flow controller as defined in claim 7, further comprising a bypass purge line for providing a fluid flow through said injection means to prevent pluggage thereof.

9. A pulverized coal flow controller as defined in claim 8, wherein said injecting means includes a plurality of injection nozzles at an angle of about 45° opposite the flow of the mixture.

10. A pulverized coal flow controller as defined in claim 7, wherein said controlling means includes a computer regulating a current/pressure converter.

11. A pulverized coal flow controller as defined in claim 7, wherein said primary fluid is compressed air.

12. A method of supplying a controlled flow of fluid transported solid particles, comprising the steps of:

suspending solid particles in a vessel to form a mixture of solid particles and a primary fluid;

discharging the mixture through at least one feed pipe out of the vessel;

injecting a fluid under pressure into at least one feed pipe;

creating with the injected fluid a recirculating zone proportional in size to the injection pressure of the fluid in the feed pipe;

measuring the flow in the feed pipe downstream from the recirculation zone;

establishing a signal indicative of the flow; and controlling the fluid injection pressure for the feed pipe in response to changes in the flow signal.

13. A method as defined in claim 12, further comprising the step of providing fluid flow through a bypass purge line for preventing pluggage of injection nozzles.

14. A method as defined in claim 13, wherein said fluid is injected at an angle opposite the flow of said mixture.

15. A method as defined in claim 14, wherein said angle is about 45°.

* * * * *

UNITED STATES PATENT AND TRADEMARK OFFICE

CERTIFICATE OF CORRECTION

PATENT NO. : 4,903,901

DATED : Feb. 27, 1990

INVENTOR(S) : Kim et al.

It is certified that error appears in the above-identified patent and that said Letters Patent is hereby corrected as shown below:

On the first page of the patent, please insert the following: --[73] Assignee: The Babcock & Wilcox Company, New Orleans, La.--

Signed and Sealed this

Twenty-fourth Day of December, 1991

*Attest:*

*Attesting Officer*

HARRY F. MANBECK, JR.

*Commissioner of Patents and Trademarks*